US005447381A

United States Patent [19]

Kimura et al.

[11] Patent Number: 5,447,381

[45] Date of Patent: Sep. 5, 1995

[54] PIEZOELECTRIC PRINTING HEAD

[75] Inventors: Daisuke Kimura; Yuji Oshime; Syuichi Yamaki, all of Kawasaki, Japan

[73] Assignee: Fujitsu Limited, Kawasaki, Japan

[21] Appl. No.: 373,452

[22] Filed: Jan. 17, 1995

Related U.S. Application Data

[63] Continuation of Ser. No. 57,825, May 7, 1993, abandoned.

[30] Foreign Application Priority Data

May 8, 1992 [JP] Japan ..... 4-116064
May 8, 1992 [JP] Japan ..... 4-116065
Jun. 23, 1992 [JP] Japan ..... 4-164470

[51] Int. Cl.[6] ..... B41J 2/295

[52] U.S. Cl. ..... 400/124.16; 400/124.01; 400/124.23

[58] Field of Search ..... 400/124, 124.01, 124.11, 400/124.16, 124.23; 101/93.05

[56] References Cited

U.S. PATENT DOCUMENTS

| | | | |
|---|---|---|---|
| 3,927,410 | 12/1975 | Pimbley | 346/140 |
| 4,193,703 | 3/1980 | Sakmann | 400/124 |
| 4,874,978 | 10/1989 | Sakaida et al. | 400/124 |
| 5,005,994 | 4/1991 | Yano | 400/124 |
| 5,133,612 | 7/1992 | Yamazaki et al. | 400/124 |
| 5,167,458 | 12/1992 | Andou | 400/124 |
| 5,180,147 | 1/1993 | Andersson et al. | 267/136 |
| 5,214,341 | 5/1993 | Itoh et al. | 400/124 |

FOREIGN PATENT DOCUMENTS

| | | |
|---|---|---|
| 0416551 | 3/1991 | European Pat. Off. . |
| 0503871 | 9/1992 | European Pat. Off. . |
| 0536637 | 4/1993 | European Pat. Off. . |
| 59-150756 | 8/1984 | Japan . |
| 60-48372 | 3/1985 | Japan . |
| 63-307961 | 12/1988 | Japan . |
| 231866 | 10/1991 | Japan . |
| 59-081181 | 5/1994 | Japan . |

OTHER PUBLICATIONS

Patent Abstracts of Japan vol. 8, No. 191 (M-322) (1628) 4 Sep. 1984 & JP-A-59 081 181 (Nippon Denki K.K.) 10 May 1984 *abstract*.

*Primary Examiner*—Edgar S. Burr
*Assistant Examiner*—John S. Hilten
*Attorney, Agent, or Firm*—Staas & Halsey

[57] ABSTRACT

A piezoelectric printing head includes an annular base frame and a plurality of piezoelectric actuator assemblies mounted on the base frame. Each actuator assembly includes a piezoelectric element having one end rigidly secured to the base frame and another free end, an armature having a base end and a tip end to which a printing wire is rigidly connected, and a magnifying mechanism. When the piezoelectric element is electrically energized, a displacement of the piezoelectric element is magnified and then transmitted to the printing wire. Between the base frame and the base end of the armature there is provided a vibration damping buffer member.

22 Claims, 18 Drawing Sheets

PIEZOELECTRIC PRINTING HEAD

This application is a continuation, of application Ser. No. 08/057,825, filed May 7, 1993, now abandoned.

BACKGROUND OF THE INVENTION

1. Field of the Invention

The present invention relates to a piezoelectric printing head in which a piezoelectric actuator is used.

As the printing speed of impact dot-matrix printers has increased, electromagnetic type printing heads can not be applied to such high speed printers. Therefore, printing heads using piezoelectric actuators have been reconsidered. Under these situations, however, the amount of displacement caused by the expansion and contraction of a piezoelectric element is very small, that is, the amount of displacement is only several microns. Therefore, this small displacement is magnified by a magnifying mechanism so that a printing operation can be carried out. In this case, it is necessary to prevent damage to a beam in the magnifying mechanism and the overshooting of a wire so that the printing quality can be improved and the life of the printing head can be extended.

2. Description of the Related Art

A conventional piezoelectric printing head includes a common base and piezoelectric elements, the piezoelectric printing head, an armature, and a magnifying mechanism. A plurality of piezoelectric elements are circumferentially provided in predetermined positions, and the armature and magnifying mechanism are provided corresponding to each piezoelectric element. The piezoelectric element has a base side block which is secured to the base by means of adhesion.

The armature has a beam, and a printing wire is secured to a tip of the beam. The magnifying mechanism comprises a support spring and a movable spring that are disposed in parallel with each other. The upper end portions of the springs are secured to the armature, and the lower end portion of the support spring is secured to the base, and that of the movable spring is secured to the piezoelectric element base. The piezoelectric printing head is mounted on a carrier, and moved on a platen together with the carrier. Printing is conducted when a predetermined piezoelectric element is driven at a predetermined time in the process of moving.

When a voltage is applied to a piezoelectric element, the piezoelectric element is displaced upward. Then the magnifying mechanism is activated, and the armature is rotated, so that the wire is forced to conduct a printing motion. When the printing has been completed, the supply of voltage impressed upon the piezoelectric element is removed and the armature returns to the initial position together with the piezoelectric element.

When the piezoelectric printing head in the aforementioned conventional structure is driven at high speed, stress concentration is caused in a joint portion between a leaf spring of the magnifying mechanism and the armature, so that the leaf spring is damaged. In order to relieve the stress concentration of each leaf spring, it is necessary to reduce a ratio of magnification or a characteristic frequency of the magnifying mechanism. However, magnification loss occurs in the aforementioned case, so that it is not possible to cope with high speed printing.

Also, in the aforementioned conventional structure, when the movable spring is pushed up by the displacement of the piezoelectric element, an adhesive agent connecting the piezoelectric element with the base is deformed by the reaction force. Therefore, the ratio of magnification or the characteristic frequency of the magnifying mechanism is lowered, so that a magnifying loss is caused and high speed printing cannot be carried out.

Further, in the conventional printing head having the aforementioned structure and function, the width of the beam joint portion is the same as that of the armature, so that a stress concentration is caused in a position close to the upper and lower end portions of the beam joint portion. For that reason, the beam thickness cannot be reduced, and the printing speed cannot be increased.

SUMMARY OF THE INVENTION

An object of the present invention is to provide a piezoelectric printing head capable of preventing the occurrence of stress concentration on each spring of the magnifying mechanism in the case of high speed printing.

Another object of the present invention is to provide a piezoelectric printing head in which the joint strength between the piezoelectric element and the base is increased.

Still another object of the present invention is to provide a printing head capable of preventing the occurrence of stress concentration on the joint of the armature and the beam so that a printing operation can be carried out at high speed.

According to the first aspect of the present invention, there is provided a piezoelectric printing head comprising: a base frame; a plurality of piezoelectric actuator assemblies mounted on said base frame, each actuator assembly comprising: a piezoelectric element having one end rigidly secured to said base frame and another free end; an armature having a base end portion and a tip end to which a printing wire is rigidly connected; a magnifying mechanism including a support spring for connecting said base frame to said base end portion of the armature at a first position and a movable spring, arranged substantially in parallel to said support spring, for connecting said free end of the piezoelectric element to said base end portion of the armature at a second position adjacent to said first position, so that, when said piezoelectric element is electrically energized, a displacement of said piezoelectric element is magnified to be transmitted to said printing wire; and a vibration damping buffer member disposed between said base frame and said base end of the armature.

When voltage is impressed upon a piezoelectric element, a deformation (displacement) corresponding to the voltage is generated due to the piezoelectric effect, so that the movable spring of the magnifying mechanism is pushed up. As a result of the foregoing, the armature is rotated in the printing direction, so that a magnified displacement is given to the wire, and printing is carried out by the wire. In the aforementioned operation, motions unnecessary for printing are restricted by a buffer member, so that the support and movable springs are not damaged by the overshooting and undershooting of the armature assembly.

It is advantageous that said base frame is substantially annular and has a substantially L-shaped cross-section comprising a horizontal bottom portion projecting inward and a side vertical portion extending upward from said bottom horizontal portion, said piezoelectric element is rigidly secured to an upper surface of the horizontal bottom portion of the base frame, and said support spring is rigidly connected to an inner surface of said side vertical portion of the base frame.

It is also advantageous that said support spring is rigidly connected to an upper position of said inner surface of said side vertical portion adjacent to said free end of the piezoelectric element, and said buffer member covers said support spring and said movable spring.

It is also advantageous that said side vertical portion of the base frame has an upper surface, and said buffer member is disposed between said upper surface of the vertical portion and said base end of the armature. Said base frame further comprises an upper projection projecting upward from said upper surface of the side vertical portion, and said buffer member is disposed between said upper projection and said base end of the armature. Said upper projection has a horizontal extension extending from an upper end of said upper projection so as to cover said base end of the armature, and said buffer member is filled in a region defined by said upper projection, said extension, and said base end of the armature.

It is also advantageous that said movable spring is connected to said free end of the piezoelectric element by means of a block, and said buffer member is also disposed between said block and said base end of the armature. Said block has a substantially horizontal upper surface which is substantially horizontally level with said upper surface of the vertical portion, and said buffer member is disposed between said upper surface of the block and said base end of the armature.

It is also advantageous that said block has an upper surface provided with a groove or recess, at least a part of said base end of the armature is accommodated in said recess, and said buffer member is disposed in said recess, so that removal of said buffer member from said recess is prevented.

According to a second aspect of the present invention, there is provided a piezoelectric printing head comprising: a base frame; a plurality of piezoelectric actuator assemblies mounted on said base frame, each actuator assembly comprising: a piezoelectric element having one end connected to said base frame and another free end; an armature having a base end portion and a tip end to which a printing wire is rigidly connected; a magnifying mechanism comprising at least means for connecting said free end of the piezoelectric element to said base end portion of the armature, so that, when said piezoelectric element is electrically energized, a displacement of said piezoelectric element is magnified to be transmitted to said printing wire; said one end of the piezoelectric element having a block which is connected to said base frame by means of a connecting member comprising an adjustable screw so as to give a prestress to said piezoelectric element; and an adhesive agent adhering said connecting member to said block of the piezoelectric element.

The block of the piezoelectric element is directly connected with the base frame by the adjustment screw. Therefore, the amount of compressive deformation which has conventionally been a problem, is reduced solving the problem in the case where the block of the piezoelectric element is connected with the base frame by an adhesive agent.

It is advantageous that one of said block and said connecting member has a cut-out portion and the other has a protruding portion which is engaged with said cut-out portion, and said adhesive agent is filled in a gap between said protruding portion and said cut-out portion.

It is also advantageous that a releasing member is provided on said base frame over at least a region opposite to said block, in such a manner that an attachment of the adhesive agent to said base frame is prevented.

According to the third aspect of the present invention, there is provided a piezoelectric printing head comprising: a base frame; a plurality of piezoelectric actuator assemblies mounted on said base frame, each actuator assembly comprising: a piezoelectric element having one end connected to said base frame and another free end; an armature; a beam having a base end rigidly connected to said armature and a tip end to which a printing wire is rigidly connected; a magnifying mechanism comprising at least means for connecting said free end of the piezoelectric element to said armature, so that, when said piezoelectric element is electrically energized, a displacement of said piezoelectric element is magnified to be transmitted to said printing wire; said armature and said beam having respective connecting portions connected to each other; a width of said connecting portion of the beam in the moving direction is larger than a width of said connecting portion of the armature in the moving direction.

The beam is wide in the joint portion between the beam and the armature, and protrudes from both sides of the armature. Therefore, the conventional problematic stress concentration caused in the upper and lower portions of the joint can be reduced. Accordingly, it is possible to reduce the beam thickness and to increase the printing speed. Also, in the second construction of the invention, the joint surface between the beam and the armature is set to be approximately perpendicular to a line connecting a rotation center of the armature with a gravity center of the beam, so that the stress in the upper and lower end portions of the beam joint is made to be uniform, which is advantageous to increasing mechanical strength.

It is advantageous that said beam is plate-like, said connecting portion of the armature has a groove extending in the moving direction, and said connecting portion of said plate-like beam is inserted in said groove and rigidly engaged therewith, so that both ends of said connecting portion of said plate-like beam protrude upward and downward, respectively, from said connecting portion of the armature.

It is also advantageous that said armature has a rotation center about which said armature turns, so that a displacement of said piezoelectric element is magnified to be transmitted to said printing wire, when said piezoelectric element is electrically energized, said beam has a center of gravity, and said respective connection portions of said armature and beam including said groove of said armature extend perpendicular to a straight line passing through said rotation center and said center of gravity.

BRIEF DESCRIPTION OF THE DRAWINGS

FIGS. 9A and 9B show the structure of the assembly of the piezoelectric actuator of the piezoelectric printing head of the sixth embodiment of the present invention, in which FIG. 9A is a side view, and FIG. 9B is a front view;

DESCRIPTION OF THE PREFERRED EMBODIMENTS

Figure 1:
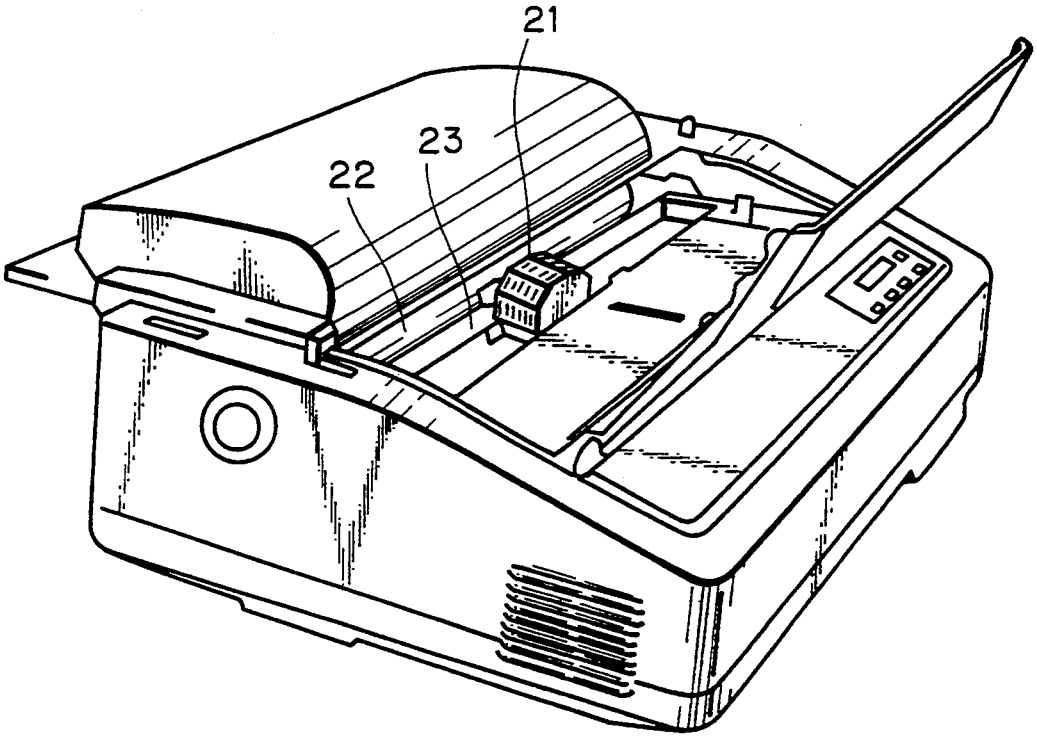
FIG. 1 is a perspective view of a printer in which the piezoelectric printing head of the present invention can be used.
Figure 2:
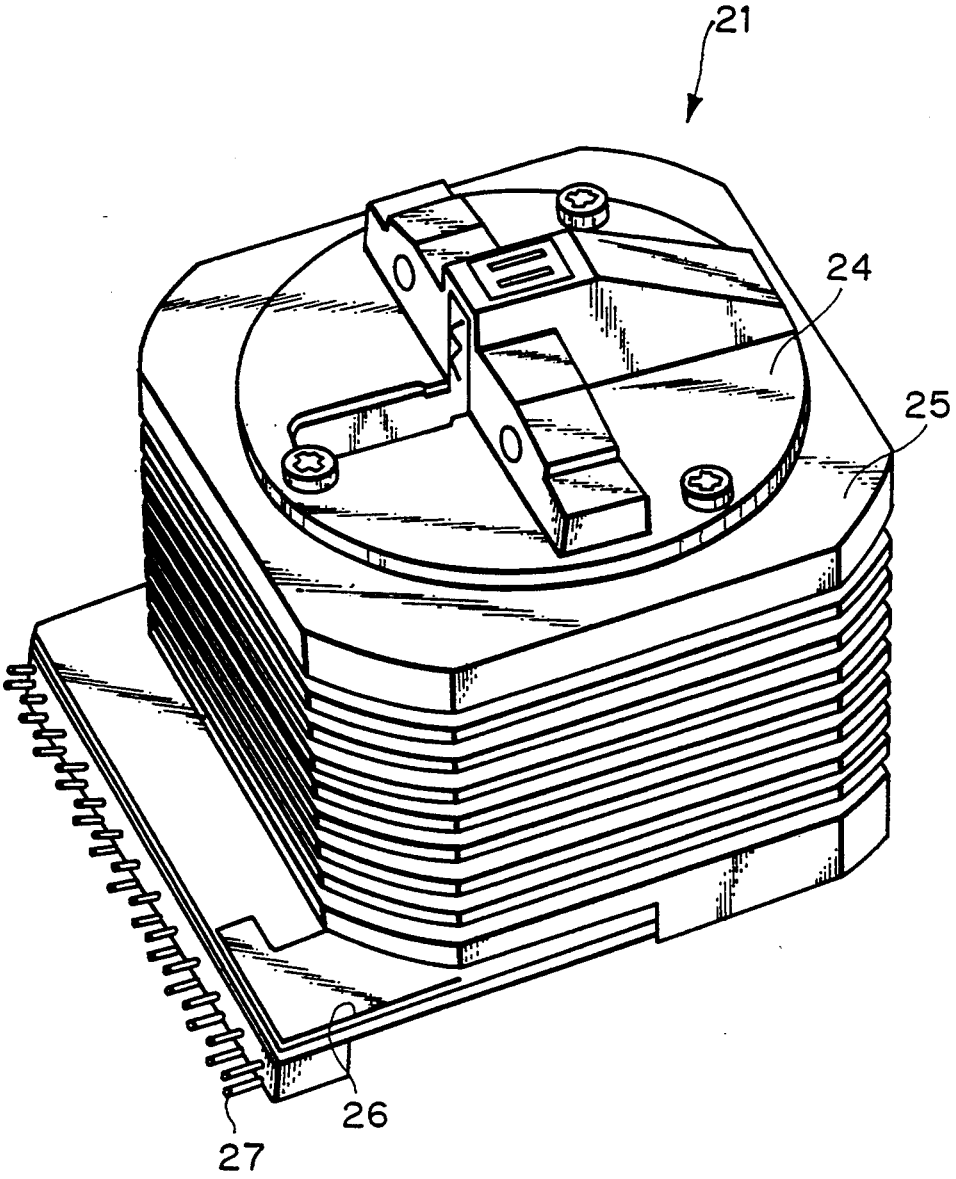
FIG. 2 is perspective view showing the appearance of the piezoelectric printing head of the present invention.

FIG. 1 is a perspective view showing the appearance of a printer in which a piezoelectric printing head is used. In the drawing, numeral 21 is a piezoelectric printing head, numeral 22 is a platen, and numeral 23 is a guide. The piezoelectric printing head 21 is mounted on a carrier which is movable along the platen 22 and guided by the guide 23. The head 21 is thus moved together with the carrier so as to perform printing. The appearance of the piezoelectric printing head 21 is shown in FIG. 2. Numeral 24 is a nose to guide the wires for conducting the printing operation. Numeral 25 is a heat sink, numeral 26 is a printed circuit board, and numeral 27 is a connector.

Figure 3:
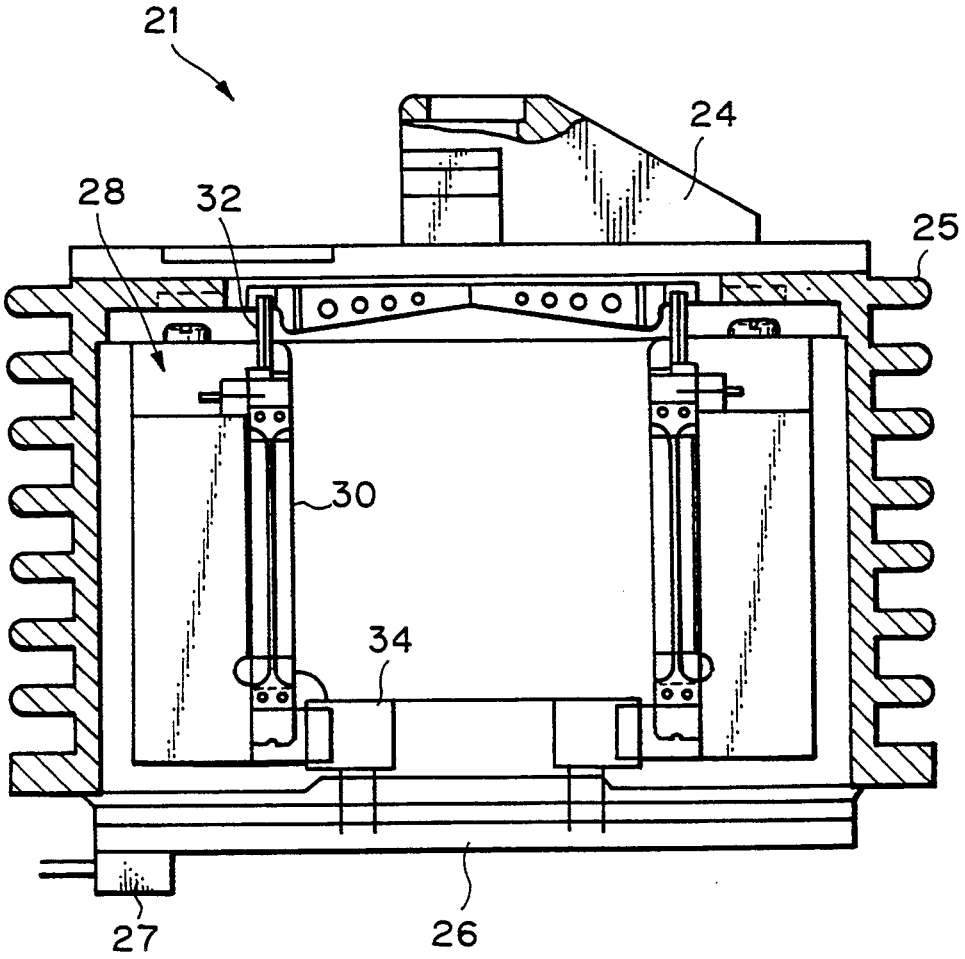
FIG. 3 is a side view showing the structure of the piezoelectric printing head of the present invention.

FIG. 3 is a side view showing the structure of the piezoelectric printing head 21. A piezoelectric actuator assembly 28 is provided in the heat sink 25 of the piezoelectric printing head 21.

Figure 4:
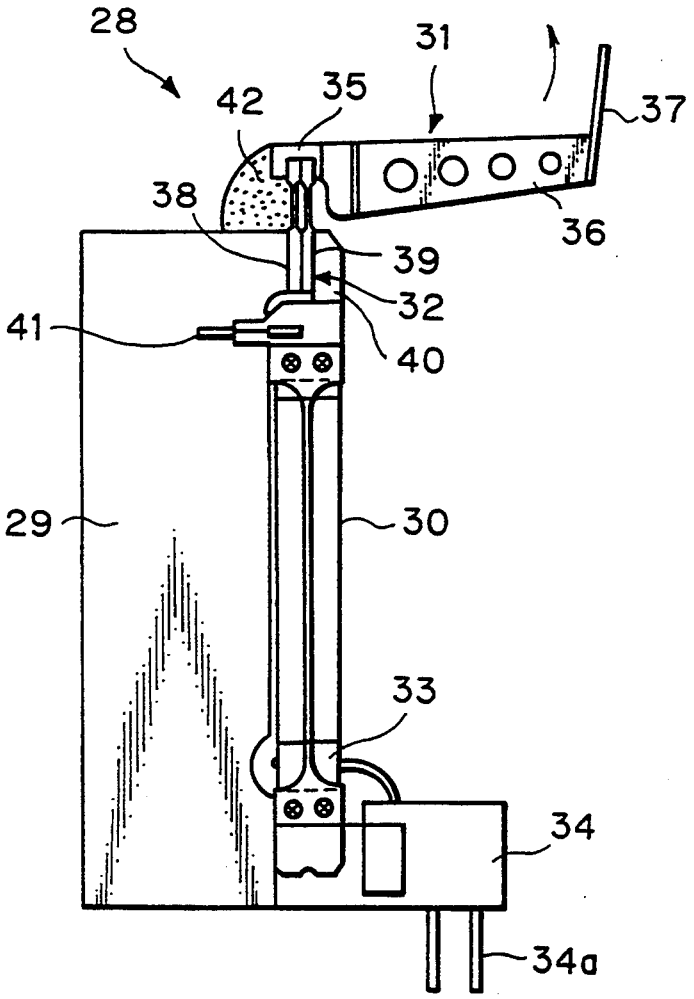
FIG. 4 is a side view of the assembly of the piezoelectric actuator of the piezoelectric printing head of the first embodiment of the present invention.

FIG. 4 shows a first embodiment of the present invention. The structure and function of this piezoelectric actuator assembly 28 will be explained as follows, with reference to FIG. 4.

The piezoelectric actuator assembly 28 includes a common annular base 29, piezoelectric element 30, armature 31, and magnifying mechanism 32. A plurality of piezoelectric elements 30 are circumferentially provided in predetermined positions, and the armature 31 and magnifying mechanism 32 are respectively provided corresponding to each piezoelectric element 30. The piezoelectric element 30 is provided when a base side block 33 provided on the lower side is secured to the base 29 by means of adhesion. Numeral 34 is a connector connected to each electrode of the piezoelectric element 30, wherein the connector 34 is mounted on the base 29, and its terminal 34a is connected to the connector 27 (FIG. 3) through a printed board 26.

The armature 31 is composed in such a manner that a beam 36 is integrally connected with a base portion 35, and a printing wire 37 is secured to the tip of the beam 36. The magnifying mechanism 32 comprises a support spring 38 and a movable spring 39 that are disposed in parallel with each other. The upper end portions of the springs 38 and 39 are secured to the base portion 35, and the lower end portion of the support spring 38 is secured to the base 29, and the lower end of the movable spring 39 is secured to a block 40 that is different from the base 29. Numeral 41 is a horizontal spring to restrict a lateral displacement of the upper portion of the piezoelectric element 30.

In the piezoelectric printing head constituted in the aforementioned manner, a buffer member 42 is provided between the upper portion of the base 29 and the base portion 35 in the present invention. Silicon gel is used for the buffer member 42 so as to damp and prevent vibration. In this embodiment, the buffer member 42 reaches the support spring 38. It is most appropriate to use the silicon gel of types $\omega$, $\alpha$, $\beta$ and $\gamma$ manufactured by Siegel Co. as the silicon gel in the present invention.

The piezoelectric actuator assembly 28 composed in the aforementioned manner is provided in the heat sink 25 (FIG. 3) and constitutes a piezoelectric printing head together with the nose 24 mounted on the heat sink so as to guide the wire 37. The piezoelectric printing head 21 is mounted on a carrier, and moved on a platen together with the carrier, as mentioned above. Printing is conducted when a predetermined piezoelectric element 30 is driven at a predetermined time in the process of moving. The detail of the printing operation will be described below.

In the case of printing, voltage is impressed upon the piezoelectric element 30 through the connector 34. As a result of the foregoing, the piezoelectric element 30 is displaced upward and pushes the block 40. Then the magnifying mechanism 32 is activated, and the armature 31 is rotated counterclockwise in the direction shown by an arrow, so that the wire 37 is forced to conduct a printing motion. When the printing has been completed, the supply of voltage impressed upon the piezoelectric element 30 is stopped, and the armature 31 of which printing operation has been completed, returns to the initial position together with the piezoelectric element 30.

In this embodiment, the buffer member 42 is provided between the upper portion of the base 29 and the base portion 35. Accordingly, even when a high speed printing operation is conducted, the overshooting of the armature 31 is restricted, so that the motion of the wire 37 can be stabilized. Accordingly, it becomes possible to carry out a printing operation of high quality. Moreover, the damage of the support spring 38 and the movable spring 39 caused by the overshooting of the armature 31 can be prevented.

Figure 5:
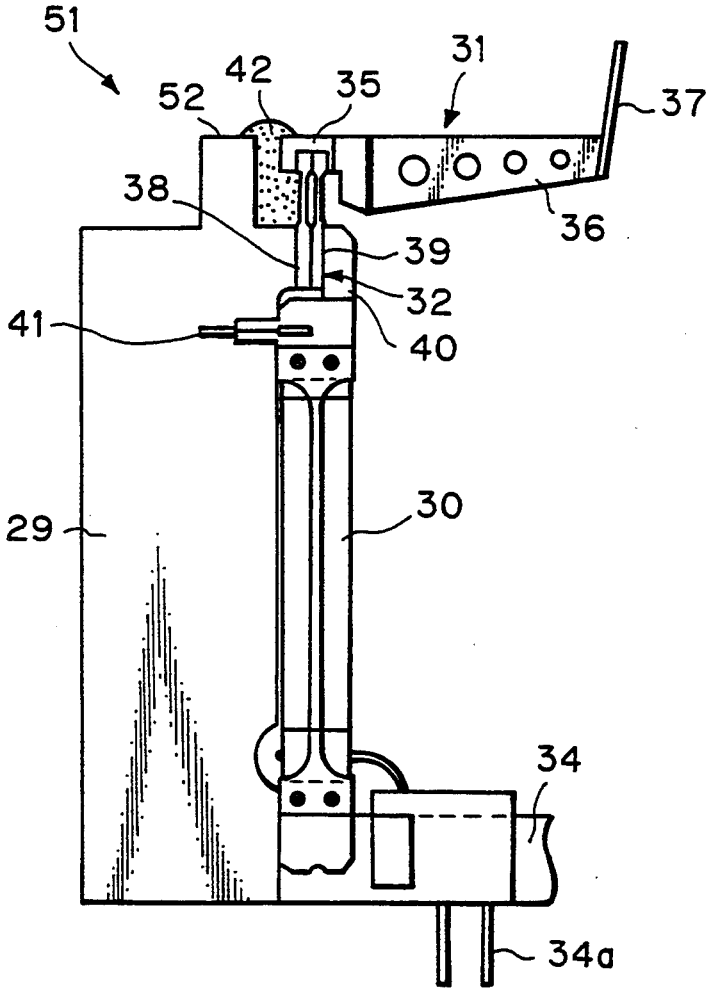
FIG. 5 is a side view of the assembly of the piezoelectric actuator of the piezoelectric printing head of the second embodiment of the present invention.

The second embodiment is shown in FIG. 5.

FIG. 5 is a side view of the piezoelectric actuator assembly of the second embodiment. The structure of a piezoelectric actuator assembly 51 is the same as that of the aforementioned first embodiment except for a point in which a protruding portion 52 is provided on the upper portion of the base 29 and also except for a point in which the charging range of the buffer member 42 of this embodiment is different from that of the first embodiment. The buffer member 42 is charged or filled to a level of the protruding portion 52. In this embodiment, the damping effect can be improved as compared with that of the first embodiment since the protruding portion 52 supports the charged buffer member 42.

Figure 6:
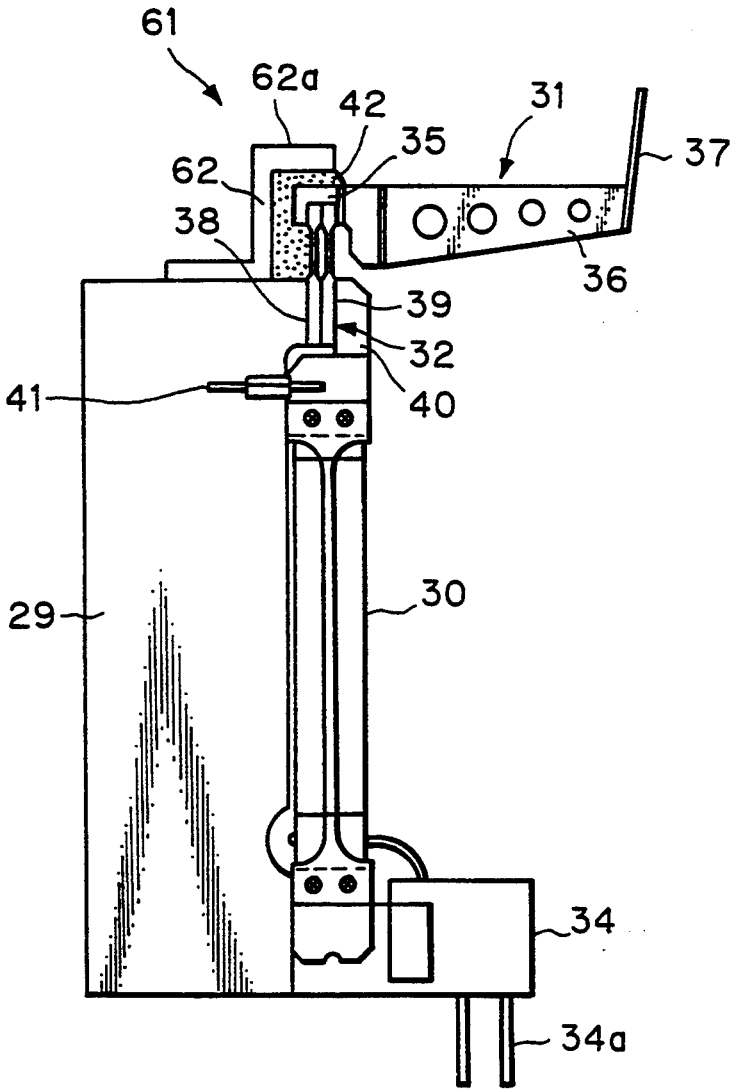
FIG. 6 is a side view of the assembly of the piezoelectric actuator of the piezoelectric printing head of the third embodiment of the present invention.

FIG. 6 shows the third embodiment.

FIG. 6 is a side view of the actuator assembly of this embodiment. The structure of a piezoelectric actuator assembly 61 is the same as that of the first embodiment except for a point in which a bracket (protruding portion) 62 is provided at the upper portion of the base 29, and also the charging range of the buffer member 42 of this embodiment is different from that of the first embodiment. The buffer member 42 is charged or filled into a space formed between an extension portion 62*a* provided to the bracket 62, and the base portion 35, the extension portion 62*a* extending to the upper portion of the base portion 35. Therefore, the damping effect can be improved as the buffer member 42 is charged into the aforementioned space.

Figure 7:
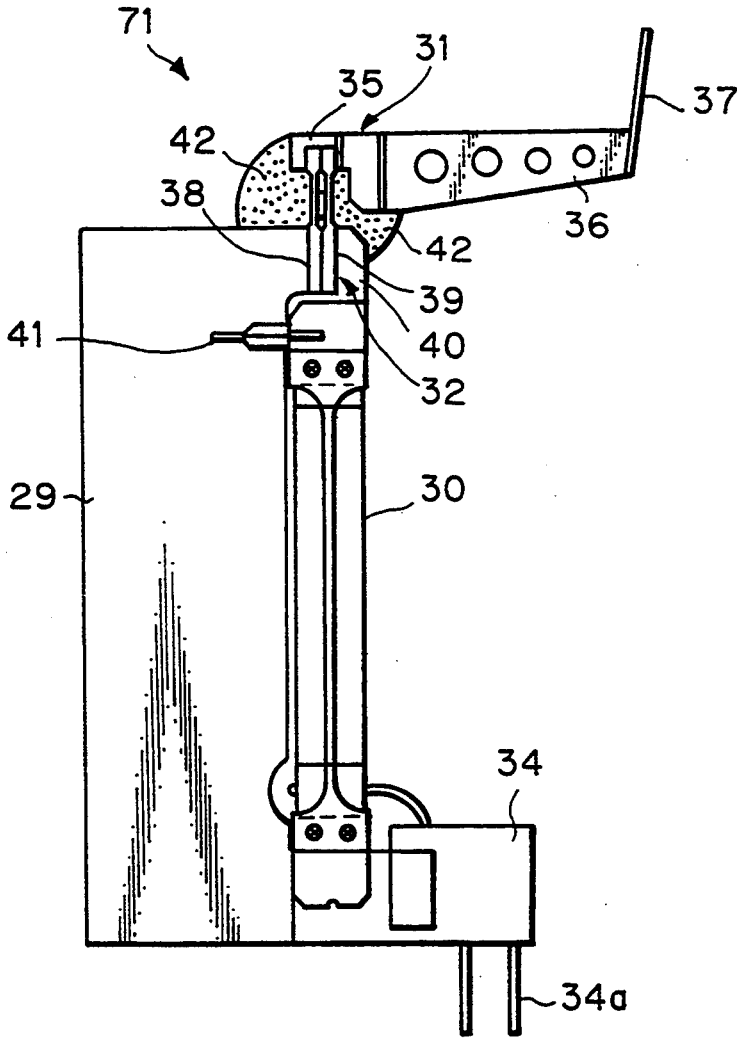
FIG. 7 is a side view of the assembly of the piezoelectric actuator of the piezoelectric printing head of the fourth embodiment of the present invention.

FIG. 7 shows the fourth embodiment.

FIG. 7 is a side view of the piezoelectric actuator assembly of this embodiment. The structure of this embodiment is different from that of the first embodiment in that the buffer member 42 is also provided on the undershooting side. In this embodiment, the buffer member 42 is provided on the undershooting side between the base portion 35 and the block 40 in such a manner that the support spring 38 and the movable spring 39 are surrounded with the buffer member 42. Consequently, the damping effect and the spring damage prevention effect can be further improved.

Figure 8:
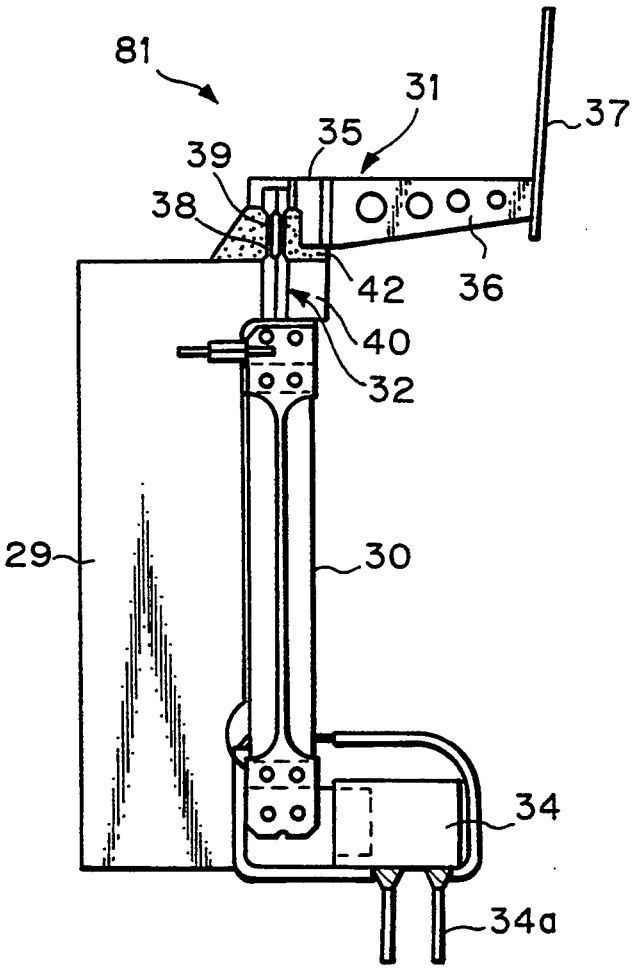
FIG. 8 is a side view of the assembly of the piezoelectric actuator of the piezoelectric printing head of the fifth embodiment of the present invention.

FIG. 8 shows the fifth embodiment.

FIG. 8 is a side view of a piezoelectric actuator assembly 81 of this embodiment. The structure of this embodiment is different from that of the fourth embodiment in that the upper portion of the block 40 is flat. As a result of the foregoing, it is difficult for the buffer member 42 provided between the base portion 35 and the block 40 to be hung.

Figure 9B:
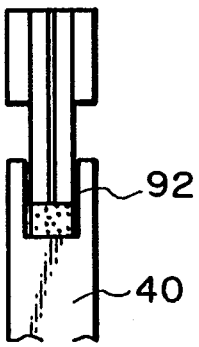
Figure 9A:
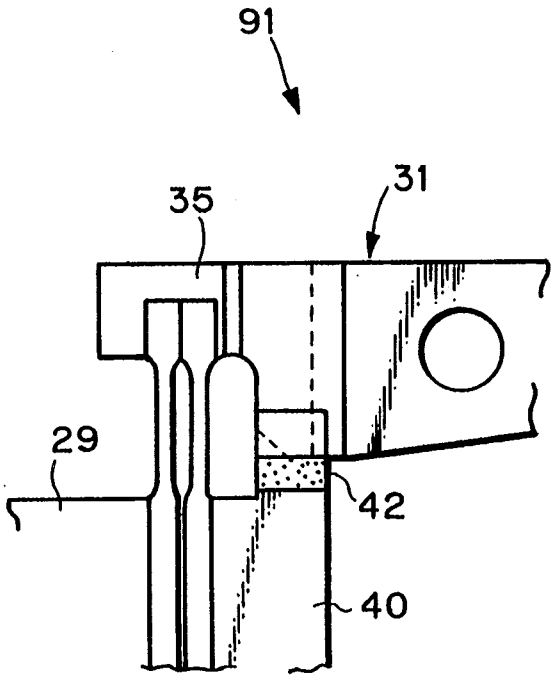

FIGS. 9A and 9B show a structure of a piezoelectric actuator 91 of this embodiment. FIG. 9A is a side view, and FIG. 9B is a front view. The structure of this embodiment is different from that of the fifth embodiment in that a groove 92 for accommodating the buffer member 42 is provided in the upper portion of the block 40. As a result of the foregoing, the buffer member 42 can be positively charged into a predetermined position.

As described above, according to the above-mentioned embodiments as shown in FIGS. 1 to 9B, the printing quality can be improved, and the reliability of the apparatus can be improved when the damage of the magnifying mechanism is prevented in a high speed printing operation.

Figure 10:
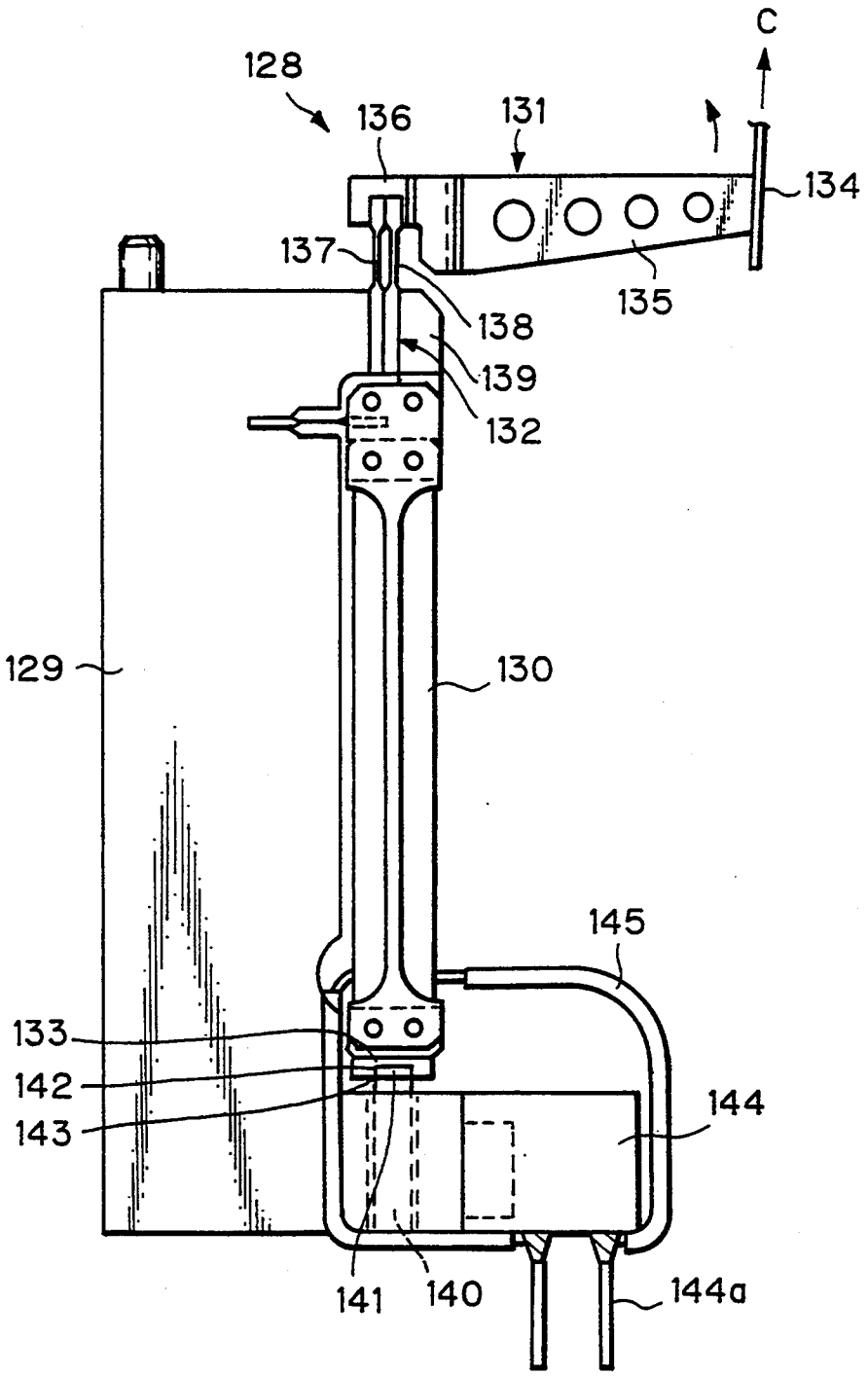
FIG. 10 is a side view of the piezoelectric actuator assembly of the seventh embodiment of the present invention.
Figure 11:
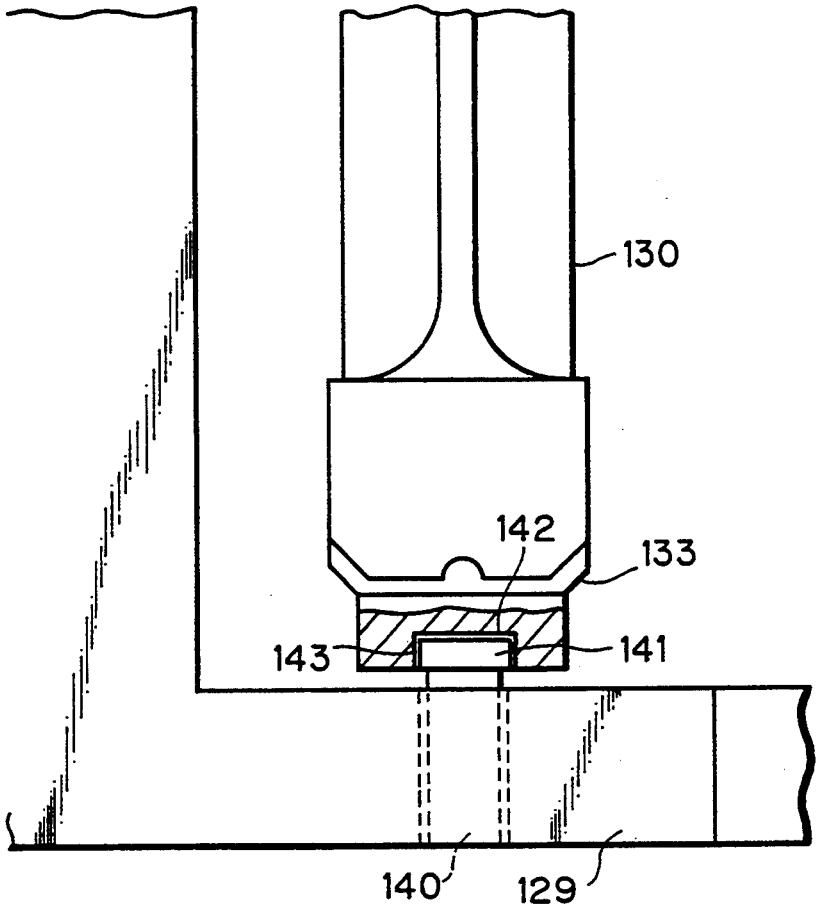
FIG. 11 is an enlarged view showing a primary portion of FIG. 10.

The seventh embodiment is shown in FIGS. 10 and 11.

FIG. 10 is a side view of the actuator assembly 128 of this embodiment. The piezoelectric actuator assembly 128 mainly includes a base 129, piezoelectric element 130, armature 131, and magnifying mechanism 132. The base portion side block 133 secured to the lower portion of the piezoelectric element 130 is connected with the base 129 (the specific connection structure will be described later). A plurality of piezoelectric elements 130 are circumferentially disposed at predetermined intervals, and the magnifying mechanism 132 and the armature 131 are provided corresponding to each piezoelectric element 130.

The armature 131 is composed in such a manner that a beam 135, the tip portion of which is connected with a wire 134, is integrally secured to a base portion 136. The magnifying mechanism 132 comprises a support spring 137 and a movable spring 138 that are approximately disposed in parallel with each other. The ends of the support spring 137 are connected with the base portion 136 and the base 129, respectively, and the ends of the movable spring 138 are connected with the base portion 136 and the block 139 (different from the base 129).

In the piezoelectric actuator assembly 128 constituted in the manner described above, the joint system of the base portion side block 133 with respect to the base 129 is different from that of a conventional one. As the detail is shown in FIG. 11, the joint system of this structure is constituted in the following manner: an adjustment screw 140 of which the tip has a protruding portion 141, is screwed in the base 129 so that the adjustment screw 140 is opposed to a base side block 133; a cut-out portion 142 is provided in the base side block 133; the protruding portion 141 is engaged with the cut-out portion 142, and the adjustment screw 140 is fastened while an adhesive agent 143 is coated in a gap formed in the engagement portion, so that the piezoelectric actuator assembly 128 is connected with the base 129 under the condition that the piezoelectric element 130 is previously given a force.

In a printing operation, voltage is impressed upon a predetermined piezoelectric element 130 through a connector 144. As a result of the foregoing, the piezoelectric element 130 is displaced upward, so that the movable spring 138 is pushed up. Then, the armature 131 is rotated in the direction of an arrow shown in FIG. 10 by the action of the magnifying mechanism 132. Therefore, a magnified displacement is transmitted to the wire 134. As a result, the wire 134 is moved in the direction of C by a predetermined amount. In this manner, the printing is carried out. After the printing operation has been completed, each member returns to the initial position.

Conventionally, high speed printing can not be accomplished since a magnifying loss occurs in this printing operation. However, as described before, in the present invention, the base portion side block 133 is directly connected with the base 129 under the condition that the piezoelectric element 130 is previously given a force. Therefore, the compressive deformation caused in the case where an adhesive agent is conventionally applied is reduced. Accordingly, it is possible to eliminate the magnifying loss so as to carry out a high speed printing operation. Incidentally, the adhesive agent 143 strengthens the engagement between the base portion side block 133 and the protruding portion 141, which is different from the conventional piezoelectric printing head.

A terminal 144*a* of the connector 144 is connected with the common connector 27 (FIG. 3) through the printed board 26 (FIG. 3). Therefore, electrical power is supplied to the piezoelectric element 130 through the connector 27. The terminal 144*a* is connected with each electrode of the piezoelectric element 130 through a lead wire 145.

Figure 12:
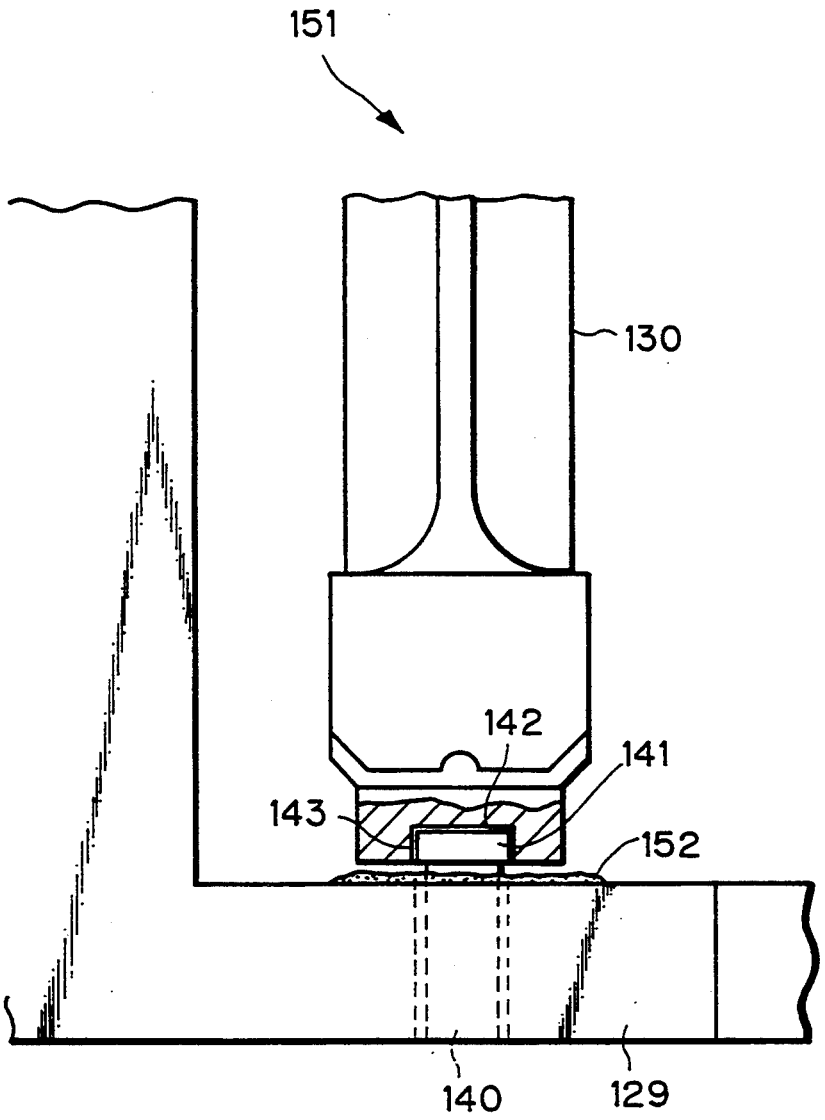
FIG. 12 is a side view showing a primary portion of the piezoelectric actuator of the eighth embodiment of the present invention.

FIG. 12 is a view showing the eighth embodiment.

FIG. 12 is a side view showing a primary portion of a piezoelectric actuator assembly 151 of this embodiment. The piezoelectric actuator assembly 151 is constituted in such a manner that a mold releasing member 152 made of polytetrafluoroethylene or silicon is added to the piezoelectric actuator assembly 128 shown in FIGS. 10 and 11. The base 129 is coated with the releasing member 152 in a position where the piezoelectric element 130 is connected with the base portion side block 133, so that the releasing member 152 prevents the adhesion of the adhesive agent onto the surface of the base 129.

In this embodiment, even when the adhesive agent spills downward from a gap between the protruding portion 141 and the cut-out portion 142, it does not adhere onto the base 129 since the releasing member 152 is provided. Consequently, it is positively guaranteed that the base portion side block 133 and the base 129 are directly connected. Therefore, it is more effective.

Figure 13:
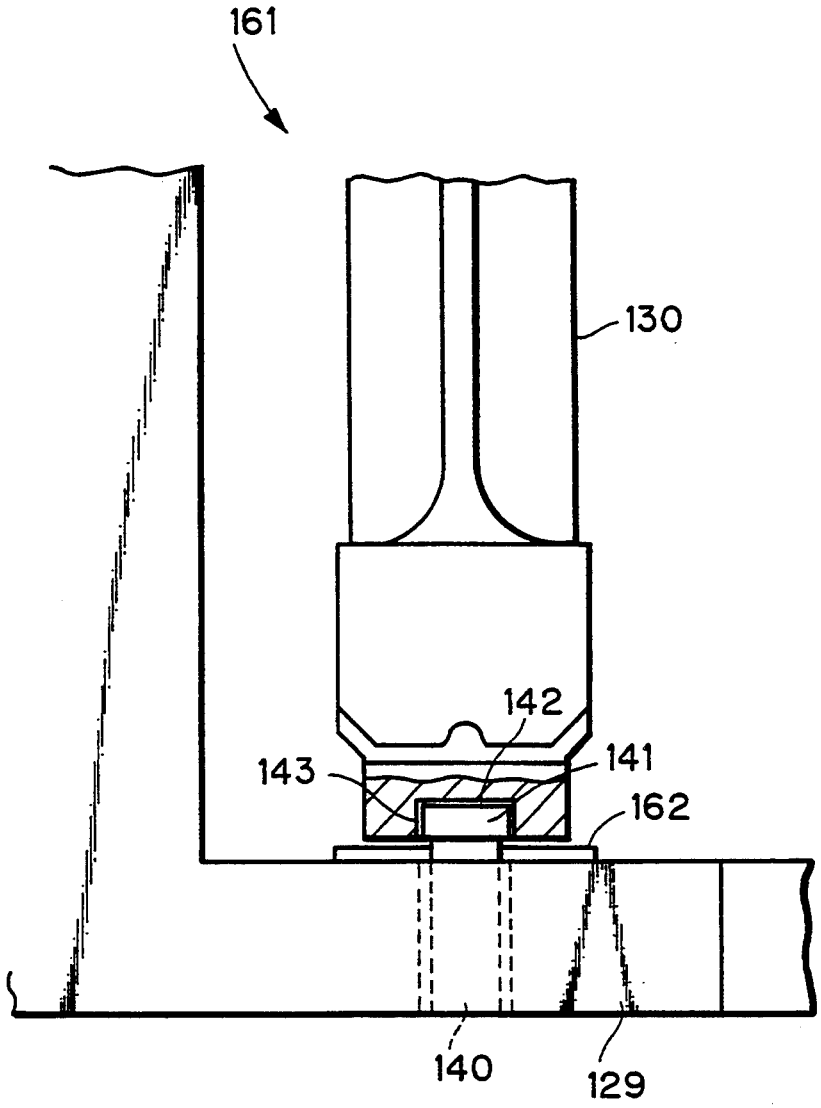
FIG. 13 is a side view showing a primary portion of the piezoelectric actuator of the ninth embodiment of the present invention.

FIG. 13 is a view showing the ninth embodiment.

FIG. 13 is a side view showing a primary portion of a piezoelectric actuator assembly 161 of this embodiment. The piezoelectric actuator assembly 161 is composed in such a manner that a sheet-like releasing member 162 made of polytetrafluoroethylene or silicon is added to the piezoelectric actuator assembly 128 shown in FIGS. 10 and 11. The releasing member 162 is inserted onto the base 129 in a position close to the joint portion as shown in the drawing, so that the adhesive agent is prevented from adhering onto the base 129.

In this embodiment, the same effect as that of the eighth embodiment can be provided.

As described above, according to the above-mentioned embodiments as shown in FIGS. 10 to 13, the piezoelectric element is directly connected with the base when the protruding portion of the adjustment screw is engaged with the cut-out portion of the base side block. Accordingly, even when a printing operation is carried out at high speed, the characteristic frequency and the magnifying ratio are not lowered, so that printing of high quality can be realized. In the case where a releasing member is provided on the base in a position close to the joint of the piezoelectric element, the surplus adhesive agent is prevented from adhering onto the base. Therefore, it can be positively guaranteed that the base plate side block and the base are directly connected with each other.

Figure 14:
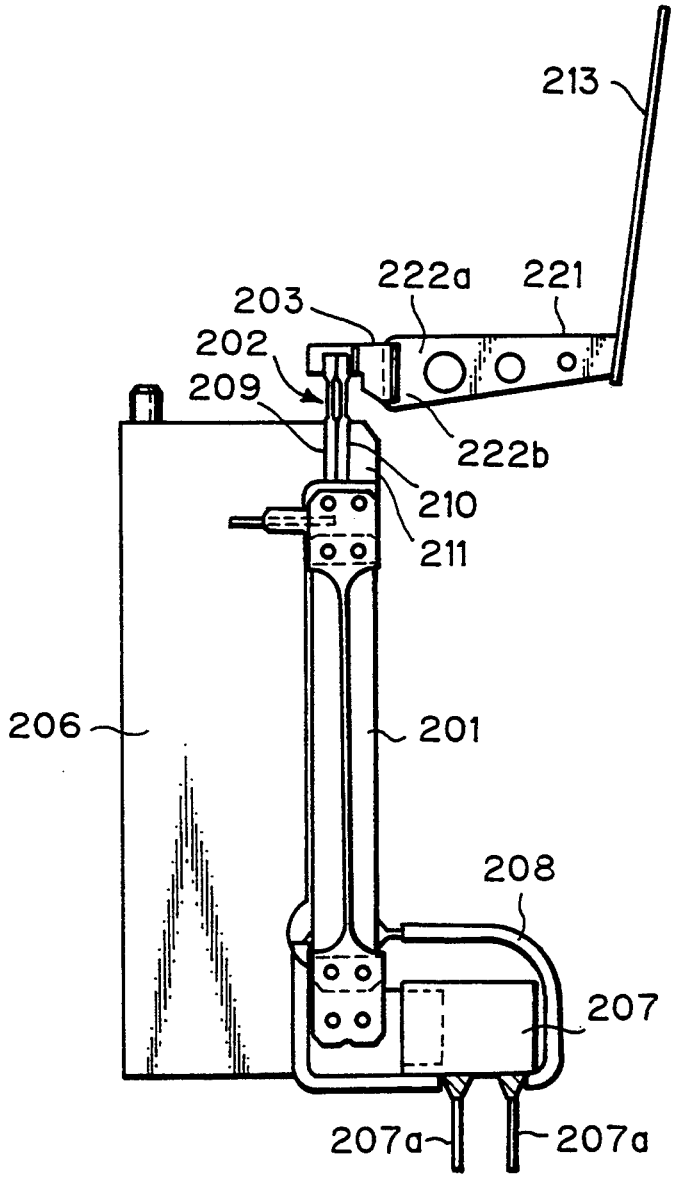
FIG. 14 is a side view showing the structure of the piezoelectric actuator assembly of the printing head of the tenth embodiment of the present invention.
Figure 15A:
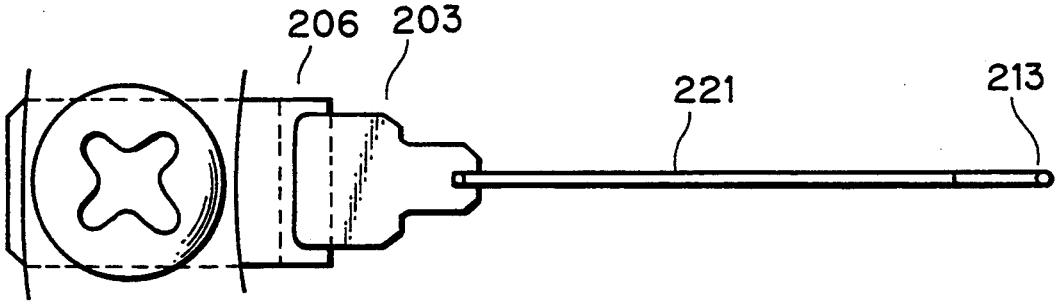
FIG. 15A is an enlarged plan view of a primary portion in FIG. 14.
Figure 15B:
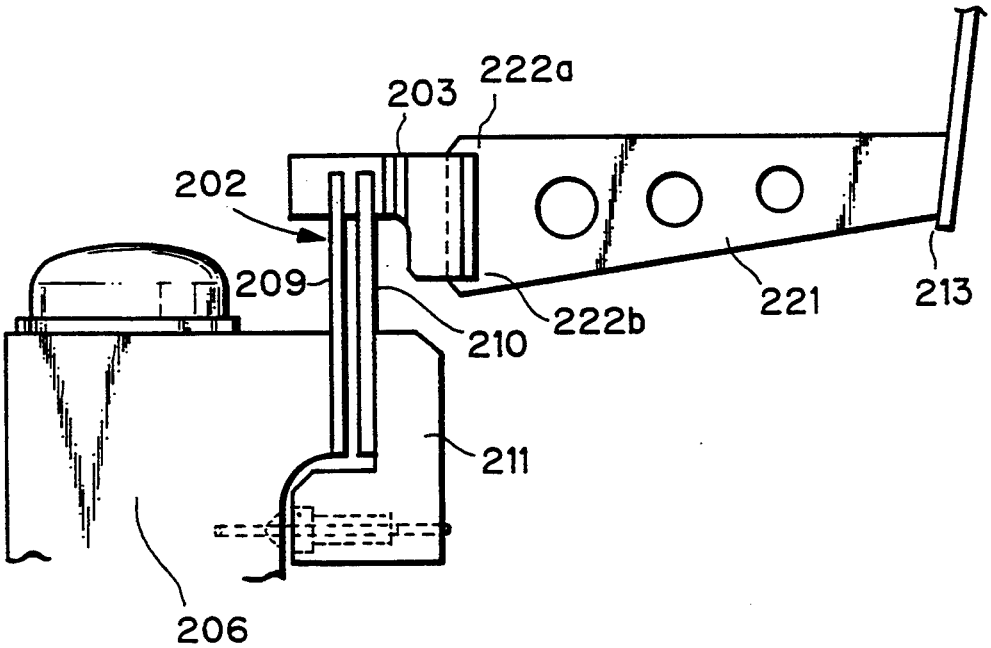
FIG. 15B is an enlarged side view of the primary portion in FIG. 14.

The tenth embodiment is shown in FIGS. 14, 15A and 15B.

FIG. 14 is a side view showing the structure of the piezoelectric actuator assembly of the printing head of this embodiment. FIGS. 15A and 15B show a primary portion of FIG. 14, wherein FIG. 15A is a plan view and FIG. 15B is a side view. In the drawings, numeral 221 is a beam. The beam 221 is made wide at the joint portion with the armature 203, and protrudes from both end portions of the armature 203.

As described above, in this embodiment, the beam 221 is wide in the joint portion between the beam 221 and the armature 203, so that it protrudes from the top and bottom of the end portion of the armature 203. Therefore, the stress concentration in the upper and lower end portions 222*a*, 222*b* of the joint portion can be reduced. Consequently, it is possible to reduce the beam thickness so as to increase the printing speed. Since the operation of the piezoelectric actuator assembly is the same as that of the conventional one, the explanation will be omitted here.

Figure 16:
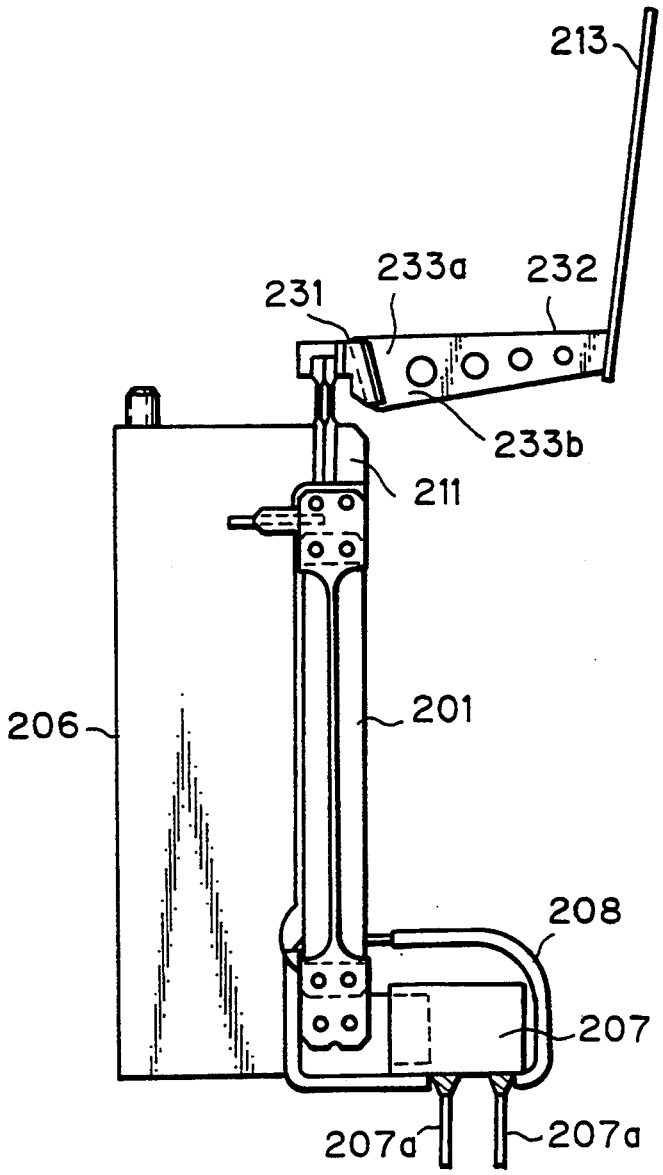
FIG. 16 is a side view showing the structure of the piezoelectric actuator assembly of the printing head of the eleventh embodiment of the present invention.
Figure 17A:
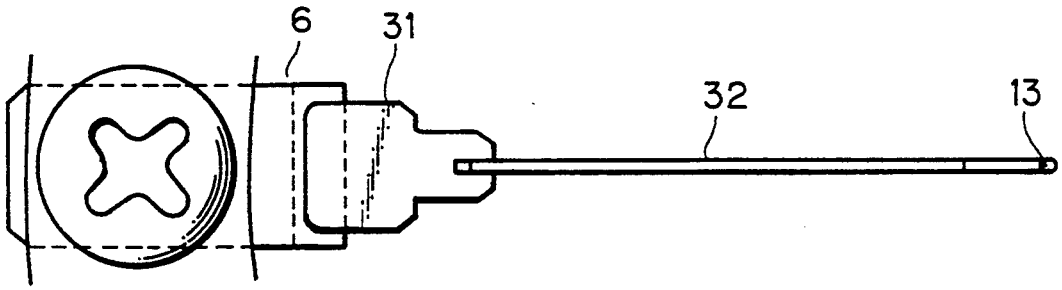
FIG. 17A is an enlarged plan view of a primary portion in FIG. 16.
Figure 17B:
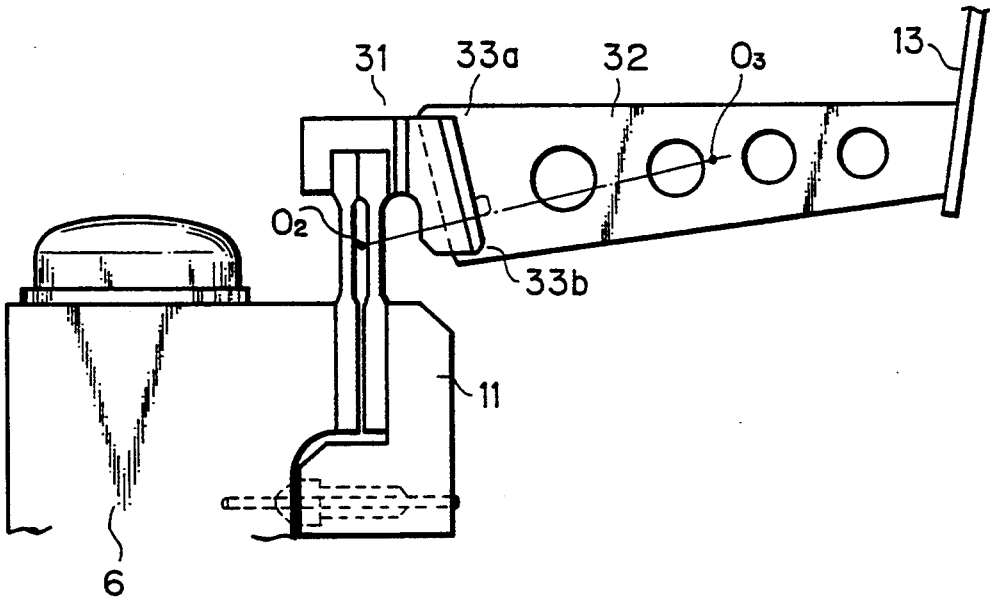
FIG. 17B is an enlarged side view of the primary portion in FIG. 16.

The eleventh embodiment is shown in FIGS. 16, 17A and 17B.

FIG. 16 is a side view showing the structure of the piezoelectric actuator assembly of the printing head of this embodiment. FIGS. 17A and 17B show a primary portion of FIG. 16, wherein FIG. 17A is a plan view and FIG. 17B is a side view. In the drawings, numeral 231 is an armature, and numeral 232 is a beam. In the same manner as the tenth embodiment, like parts are identified by the same reference characters. A joint surface of the armature 231 and the beam 232 is set to be perpendicular to a line connecting the rotation center $O_2$ of the armature 231 with the gravity center $O_3$ of the beam 232. Also, the beam 232 is wide in the joint portion between the beam 232 and the armature 231 so that the beam 232 protrudes from both sides of the armature 231.

Consequently, not only is the stress concentration of the upper and lower end portions 233*a*, 233*b* of the joint portion of the beam 232 reduced, but also the stress is made uniform in the upper and lower end portions 233*a*, 233*b* of the beam joint portion since an angle of the joint surface of the armature 231 and the beam 232 is set in the aforementioned manner. Therefore, it is advantageous in increasing the mechanical strength.

In the aforementioned embodiments, a piezoelectric element is used for the actuator. However, even when an electromagnetic type actuator is used, the present invention can be applied. Next, with reference to FIG. 18, the structure of a primary portion of a printing head in which an electromagnetic actuator is used, will be explained as follows.

Figure 18:
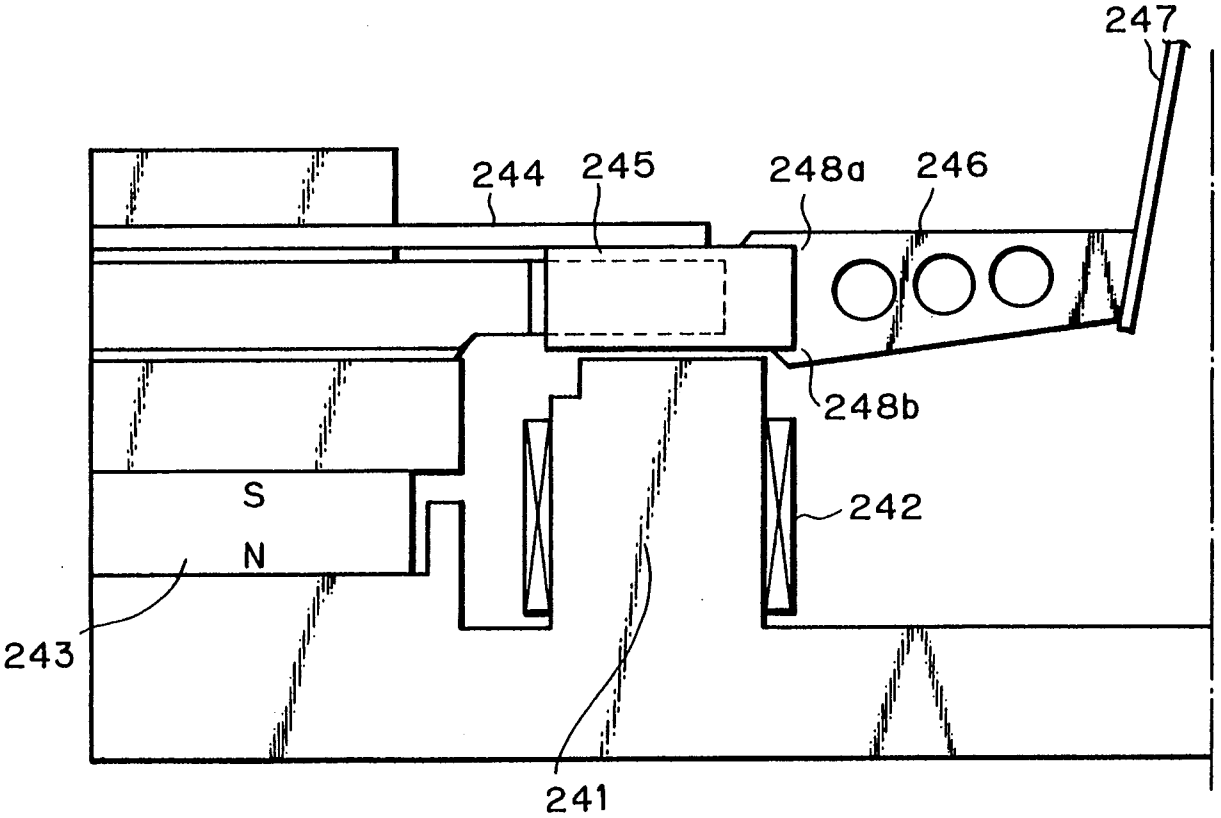
FIG. 18 is a schematic illustration of the structure of a primary portion of the printing head of an applied embodiment of the present invention.

FIG. 18 is a schematic illustration showing a primary portion of a printing head. In the drawing, numeral 241 is a core, numeral 242 is a coil engaged with the core 241, numeral 243 is a permanent magnet, numeral 244 is a cantilever type leaf spring, numeral 245 is an armature secured to a tip of the leaf spring 244, numeral 246 is a beam connected with the armature 245, and numeral 247 is a printing wire secured to a tip of the beam 246. The beam 246 is wide at a portion in which the beam 246 is connected with the armature, so that the beam 246 protrudes from both sides of the armature. Accordingly, the stress concentration on the upper and lower end portions 248*a*, 248*b* of the beam 246 in the joint portion can be reduced.

In the case where a printing operation is not conducted, the armature 245 is attracted to the core 241 by the magnetic flux generated by the permanent magnet 243 through the core 241 and armature 245, resisting the resilient force of the leaf spring 244. In the case of printing, the coil 242 is energized with current for a predetermined period of time. As a result of the foregoing, a portion of the magnetic flux is erased, and the armature 245 pushed by the leaf spring 244 is rotated in a direction so that the armature 245 can be separated from the core 241, and the printing wire 247 conducts printing.

At the completion of printing, the aforementioned power supply is stopped, and the armature 245 is attracted by the core "241" again.

As described above, according to the embodiments shown in FIGS. 14 to 17, the stress concentration caused in the joint portion of the armature and the beam can be reduced. Therefore, it is possible to reduce the weight of the beam so as to realize a printing operation of high speed.

It should be understood by those skilled in the art that the foregoing description relates to only some preferred embodiments of the disclosed invention, and that various changes and modifications may be made to the invention without departing from the spirit and scope thereof.

We claim:

1. A piezoelectric printing head comprising:

a base frame;

a plurality of piezoelectric actuator assemblies mounted on said base frame, each actuator assembly comprising:

a piezoelectric element having one end rigidly secured to said base frame and another free end;

an armature having a base end portion and a tip end to which a printing wire is rigidly connected;

a magnifying mechanism including a support spring for connecting said base frame to said base end portion of said armature at a first position and a movable spring, arranged substantially in parallel to said support spring, for connecting said free end of said piezoelectric element to said base end portion of said armature at a second position adjacent to said first position, so that, when said piezoelectric element is electrically energized, a displacement of said piezoelectric element is magnified to be transmitted to said printing wire; and a vibration damping buffer member disposed between a vertical portion of said base frame and said base end portion of said armature, wherein the space between said support spring and said movable spring is free of said buffer member, and said buffer member is a gel.

2. The piezoelectric printing head as set forth in claim 1, wherein:

said base frame is substantially annular and has a substantially L-shaped cross-section comprising a horizontal bottom portion projecting inward and a side vertical portion extending upward from said horizontal bottom portion; and said piezoelectric element is rigidly secured to an upper surface of the horizontal bottom portion of the base frame, and said support spring is rigidly connected to an inner surface of said side vertical portion of said base frame.

3. The piezoelectric printing head as set forth in claim 2, wherein said support spring is rigidly connected to an upper position of said inner surface of said side vertical portion adjacent to said free end of the piezoelectric element, and said buffer member covers said support spring and said movable spring.

4. The piezoelectric printing head as set forth in claim 2, wherein said side vertical portion of the base frame has an upper surface, and said buffer member is disposed between said upper surface of said side vertical portion and said base end of said armature.

5. The piezoelectric printing head as set forth in claim 4, wherein said base frame further comprises an upper projection projecting upward from said upper surface of said side vertical portion, and said buffer member is disposed between said upper projection and said base end portion of said armature.

6. The piezoelectric printing head as set forth in claim 5, wherein said upper projection has a horizontal extension extending from an upper end of said upper projection so as to cover said base end portion said armature, and said buffer member is filled in a region defined by said upper projection, said extension and said base end portion of the armature.

7. The piezoelectric printing head as set forth in claim 4, further comprising a block, wherein said movable spring is connected to said free end of the piezoelectric element by means of said block, and said buffer member is also disposed between said block and said base end portion of said armature.

8. The piezoelectric printing head as set forth in claim 7, wherein said block has a substantially horizontal upper surface which is substantially at the same horizontal level as said upper surface of the vertical portion, and said buffer member is disposed between said upper surface of the block and said base end portion of said armature.

9. The piezoelectric printing head as set forth in claim 7, wherein said block has an upper surface provided with a recess, at least a part of said base end portion of said armature is accommodated in said recess, and said buffer member is disposed in said recess, preventing removal of said buffer member from said recess.

10. The piezoelectric printing head as set forth in claim 1, wherein said buffer member is a silicon gel.

11. A piezoelectric printing head comprising:

a base frame;

a plurality of piezoelectric actuator assemblies mounted on said base frame, each actuator assembly comprising:

a piezoelectric element having one end rigidly secured to said base frame and another free end;

an armature having a base end portion and a tip end to which a printing wire is rigidly connected;

a magnifying mechanism comprising at least means for connecting said free end of the piezoelectric element to said base end portion of the armature, so that, when said piezoelectric element is electrically energized, a displacement of said piezoelectric element is magnified to be transmitted to said printing wire; and a vibration damping buffer member disposed between a vertical portion of said base frame and said base end portion of said armature, wherein the space between said support spring and said movable spring is free of said buffer member, and said buffer member is a gel.

12. A piezoelectric printing head comprising:

a base frame;

a plurality of piezoelectric actuator assemblies mounted on said base frame, each actuator assembly comprising:

a piezoelectric element having one end connected to said base frame and another free end;

an armature having a base end portion and a tip end to which a printing wire is rigid connected;

a magnifying mechanism comprising at least means for connecting said free end of the piezoelectric element to said base end portion of the armature, so that, when said piezoelectric element is electrically energized, a displacement of said piezoelectric element is magnified to be transmitted to said printing wire;

said one end of the piezoelectric element having a block which is connected to said base frame by means of a connecting member comprising an adjustable screw so as to give a prestress to said piezoelectric element;

an adhesive agent for adhering said connecting member to said block of the piezoelectric element; and wherein one of said block and said connecting member has a cut-out portion and the other has a protruding portion which is engaged with said cut-out portion, and said adhesive agent is filled in a gap between said protruding portion and said cut-out portion.

13. A piezoelectric printing head comprising:

a base frame;

a plurality of piezoelectric actuator assemblies mounted on said base frame, each actuator assembly comprising:

a piezoelectric element having one end connected to said base frame and another free end;

an armature having a base end portion and a tip end to which a printing wire is rigidly connected;

a magnifying mechanism comprising at least means for connecting said free end of the piezoelectric element to said base end portion of the armature, so that, when said piezoelectric element is electrically energized, a displacement of said piezoelectric element is magnified to be transmitted to said printing wire;

said one end of the piezoelectric element having a block which is connected to said base frame by means of a connecting member comprising an adjustable screw so as to give a prestress to said piezoelectric element;

an adhesive agent for adhering said connecting member to said block of the piezoelectric element; and a releasing member provided on said base frame over at least a region opposite to said block, in such a manner that an attachment of the adhesive agent to said base frame is prevented.

14. The piezoelectric printing head as set forth in claim 13, wherein said releasing member is one of a film and a sheet and made of one of polytetrafluoroethylene and silicon.

15. A piezoelectric printing head comprising:

a base frame;

a plurality of piezoelectric actuator assemblies mounted on said base frame, each actuator assembly comprising:

a piezoelectric element having one end connected to said base frame and another free end;

an armature;

a beam having a base end rigidly connected to said armature and a tip end to which a printing wire is rigidly connected;

a magnifying mechanism comprising at least means for connecting said free end of the piezoelectric element to said armature, so that, when said piezoelectric element is electrically energized, a displacement of said piezoelectric element is magnified to be transmitted to said printing wire;

said armature and said beam having respective connecting portions connected to each other, said connecting portion of said armature having a groove extending in a moving direction of said beam and said connecting portion of said beam being inserted into and rigidly engaged with said groove;

a width of said connecting portion of said beam in the moving direction is larger than a width of said connecting portion of the armature in the moving direction, wherein both ends of the connecting portion of said beam protrude upward and downward, respectively, from the connecting portion of said armature.

16. The piezoelectric printing head as set forth in claim 15, wherein said beam is plate-like, wherein both ends of said connecting portion of said plate-like beam protrude upward and downward, respectively, from said connecting portion of the armature.

17. The piezoelectric printing head as set forth in claim 15, wherein, said armature has a rotation center about which said armature turns, so that a displacement of said piezoelectric element is magnified to be transmitted to said printing wire when said piezoelectric element is electrically energized, said beam has a center of gravity, and said respective connection portions of said armature and beam including said groove of said armature extend perpendicular to a straight line passing through said rotation center and said center of gravity.

18. A piezoelectric printing head comprising:

a base frame; and a plurality of piezoelectric actuator assemblies mounted on said base frame, each actuator assembly comprising:

a printing wire, a piezoelectric element having a first end rigidly secured to said base frame and a second end which is free, an armature having a base end portion, and a tip end portion rigidly connected to said printing wire, a magnifying mechanism including a support spring connecting said base frame to said base end portion of said armature at a first position of said base end portion, and a movable spring, arranged substantially in parallel to said support spring and creating a gap with said first support spring, for connecting said second end of said piezoelectric element to said base end portion of said armature at a second position adjacent to said first position, wherein said magnifying mechanism magnifies a displacement of said piezoelectric element and transmits the magnified displacement to said printing wire, and vibration damping means disposed between said base end portion of said armature and said base frame, wherein said gap is free of said vibration damping means.

19. The piezoelectric printing head as claimed in claim 18, wherein said vibration damping means contacts said base end portion of said armature, said base frame and said support spring, and is at a first side of said support spring opposite a second side of said support spring which faces said movable spring.

20. The piezoelectric printing head as claimed in claim 19, further comprising:

a block connecting said movable spring with said second end of said piezoelectric element; and said vibration damping means also disposed between said based end portion of said armature and said block, and in contact with said base end portion of said armature, said block and said movable spring at a first side of said movable spring opposite a second side of said movable spring facing said support spring.

21. The piezoelectric printing head as claimed in claim 19, wherein:

said base frame is substantially annular and has a substantially L-shaped cross-section comprising a bottom portion having a surface and extending in a first direction toward said one of said plurality of piezoelectric elements and a side portion extending perpendicular to said bottom portion and substantially parallel to said one piezoelectric element; and said one piezoelectric element is rigidly secured to said surface of said bottom portion, and said support spring is rigidly connected to said side portion.

22. The piezoelectric printing head as claimed in claim 18, wherein said armature further comprises:

a first portion connected to said base end portion and having a rotation center about which said first portion turns and a connection end; and a beam having a base end rigidly connected to said connection end of said first portion and having a center of gravity, said base end and said connecting end extending perpendicularly to a straight line passing through said rotation center and said center of gravity.

* * * * *

UNITED STATES PATENT AND TRADEMARK OFFICE

CERTIFICATE OF CORRECTION

PATENT NO. : 5,447,381

DATED : September 5, 1995

INVENTOR(S) : Daisuke KIMURA et al.

It is certified that error appears in the above-indentified patent and that said Letters Patent is hereby corrected as shown below:

Column 15, line 2, change "19" to --18--.

Signed and Sealed this

Twenty-third Day of April, 1996

Bruce Lehman

*Attest:*

BRUCE LEHMAN

*Attesting Officer*

*Commissioner of Patents and Trademarks*